US007433607B2

(12) United States Patent
Thomas

(10) Patent No.: US 7,433,607 B2
(45) Date of Patent: Oct. 7, 2008

(54) SYSTEM AND METHOD FOR ORDERING COMPONENTS AND SERVICES FOR A MACHINE

(75) Inventor: Michael J. Thomas, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 208 days.

(21) Appl. No.: 11/202,441

(22) Filed: Aug. 11, 2005

(65) Prior Publication Data

US 2007/0036559 A1 Feb. 15, 2007

(51) Int. Cl.
*G03G 15/00* (2006.01)

(52) U.S. Cl. ..... 399/8; 358/1.15; 399/24; 399/81

(58) Field of Classification Search ..... 399/8, 399/9, 24, 25, 26, 27, 23, 79, 80, 81; 358/1.15; 347/19; 705/26, 27, 28; 709/224
See application file for complete search history.

(56) References Cited

U.S. PATENT DOCUMENTS 5,077,582 A 12/1991 Krevette et al. ..... 399/8
5,305,199 A 4/1994 LoBiondo et al. ..... 705/28
6,016,409 A 1/2000 Beard et al. ..... 399/33
6,023,593 A 2/2000 Tomidokoro ..... 399/8
6,108,099 A * 8/2000 Ohtani ..... 358/1.15
6,173,128 B1 1/2001 Saber et al. ..... 399/24
6,370,341 B1 * 4/2002 Haines ..... 399/24
6,529,692 B1 3/2003 Haines et al. ..... 399/27
6,798,997 B1 9/2004 Hayward et al. ..... 399/12
2002/0071133 A1 * 6/2002 Haines ..... 358/1.15 X
2002/0076225 A1 * 6/2002 Kurz et al. ..... 399/12
2003/0072027 A1 * 4/2003 Haines et al. ..... 358/1.15
2005/0254830 A1 * 11/2005 Maeda ..... 399/24 X

* cited by examiner

*Primary Examiner*—Sophia S Chen
(74) *Attorney, Agent, or Firm*—Wiggin and Dana LLP

(57) ABSTRACT

A machine comprises a processor and at least one other component. The processor determines if the other component needs service, and sends an electronic message addressed to a remote communication device accessible by a user of the machine. The service includes at least one of: repair, replacement and replenishment of the component, and the electronic message indicates the need for the service and includes information to facilitate ordering at least one of: the repair, replacement and replenishment of the other component. The electronic message may include at least one of: an e-mail message, a text message, an instant message, and an SMS message, and may be forwarded to a supplier to place an order for the repair, replacement and replenishment of the other component.

23 Claims, 6 Drawing Sheets

SYSTEM AND METHOD FOR ORDERING COMPONENTS AND SERVICES FOR A MACHINE

BACKGROUND

A common trend in machine design is to incorporate a processor into the machine to monitor a condition of the machine's components. When the condition of a component reaches a certain level, an operator of the machine is notified of the condition so that the operator may order a replacement component or schedule maintenance of the component. For example, many imaging machines, including fax machines, copiers, printers, scanners, xerographic devices, electrostatographic devices, and the like, generally have a user interface that indicates when the quantity of a consumable component (e.g., toner, ink, and the like) in the machine is low. Such machines may also provide an indication that a component is reaching the end of its effective life or otherwise needs service. In another example, automobiles will notify the driver that a level of a consumable component (e.g., oil, gas, washer fluid, and the like) is running low. Such automobiles may also notify the driver when maintenance is needed (e.g., an oil change, tire inflation, engine tune-up, and the like). While such systems work well in notifying the operator of the condition, they do not assist the operator in ordering the maintenance or replacement component. Furthermore, the operator may not be the person responsible for placing the order, and the indication on the display may be ignored. To overcome these limitations, various methods for ordering the service and replacement of components in a machine have been devised.

U.S. Pat. No. 6,798,997 to Hayward, et al., which is incorporated by reference herein in its entirety, is directed to an automatic supply ordering system for electronically ordering a consumable component or replaceable part in a marking machine. The system provides electronic identification of a condition of a replaceable component and automatically electronically sends an offer to purchase a replacement part upon identification of a threshold condition.

U.S. Pat. No. 6,529,692 to Haines, et al., which is incorporated by reference herein in its entirety, is directed to a consumable order assistance system for a computer peripheral device that includes: a computer peripheral device, a personal computer, a user interface, and a communication link. The computer peripheral device has a consumable requiring periodic replenishment. The personal computer is signal coupled with the peripheral device. The user interface is provided on one of the computer peripheral device and the personal computer, and is operative to notify a user of a state of the consumable. The communication link signal couples the personal computer with a provider of the consumable for the peripheral device. The personal computer is operative to monitor the computer peripheral device to determine the state of the consumable, and to notify a user via the user interface of a need to replenish the consumable.

U.S. Pat. No. 6,173,128 to Saber et al., which is incorporated by reference herein in its entirety, is directed to an electrophotographic printing or copying machine includes a functional module which can be readily removed and replaced. The module includes a monitor in the form of an electronically-readable memory, which includes information about how the particular module is to be operated. In a remanufacturing process, certain combinations of codes in the memory are noted to determine whether individual parts in the module should be replaced.

U.S. Pat. No. 6,023,593 to Tomidokoro, which is incorporated by reference herein in its entirety, is directed to a consumable item supplying system that includes a plurality of image forming apparatuses each using a plurality of consumable items, for example, copysheets, toner, and so on. The consumable item supplying system includes a consumable item manual requesting operation for manually requesting a consumable item from each of the image forming apparatuses. A central controller orders a consumable item from a consumable item supplier or the like when the consumable item is requested from one of the image forming apparatuses, and a data communication device can receive data representing a consumable item request by polling each of the image forming apparatuses and sending the polling results from the image forming apparatus to the central controller.

U.S. Pat. No. 6,016,409 to Beard et al., which is incorporated by reference herein in its entirety, describes status messages at which a machine will display or otherwise communicate the approach of a need to replace a module. These status messages are determined by the machine extrapolating the average daily print volume, and when a particular threshold number of days to module replacement is reached, an appropriate status message is communicated by the machine, either to an end user through a display or directly to a service provider over a network. For example, the machine can communicate a "reorder module" message at some point between 10 and 25 days (the exact day being set by user preference, or as a result of particular service plan code) before the expected end of life of the module; a "prepare to replace" message at some point between 2 and 5 days; a "replace today" message at 1-2 days; and finally a "hard stop" message when the module runs out.

U.S. Pat. No. 5,305,199 to LoBiondo, et al., which is incorporated by reference herein in its entirety, is directed to a reprographic machine that includes an inventory tracking system for monitoring consumable supplies. Usage data from a plurality of networked reprographic machines is supplied to a single tracking system for monitoring inventories of supplies consumed by the network. Automatic or semi-automatic ordering can be provided via a remote interactive communication system. Order confirmation, projected shipment dates and shipment confirmations can be provided from the reorder site. The system can provide inventory monitoring customized to a local network.

U.S. Pat. No. 5,077,582 to Kravette, et al., which is incorporated by reference herein in its entirety, is directed to a system for monitoring a variable output paper processing device. The monitoring system includes a counter which counts the number of papers processed and provides a count signal for each counted paper. A controller receives the count signals and totals the counts. The controller transmits the total count to a central station through a modem after either a predetermined time or a predetermined count. Internal diagnostic signals in the printing device are intercepted as they are transmitted to an internal display device of the printing device and transmitted to the central computer through the modem.

BRIEF SUMMARY

According to one aspect, there is provided a machine comprising a processor and at least one other component. The processor determines if the other component needs service, where the service includes at least one of: repair, replacement and replenishment of the other component. The processor sends an electronic message addressed to a remote communication device accessible by a user of the machine. The electronic message indicates the need for the service and includes information to facilitate ordering at least one of: the repair, replacement and replenishment of the other component.

According to another aspect, there is provided a method of ordering components and repair services for a machine, the method comprises: monitoring a condition of at least one component in the machine; transmitting a signal indicative of the monitored condition to a processor in the machine; applying the signal within the processor to determine if the component needs service, and sending an electronic message from the processor to a remote communication device accessible by a user of the machine. The service includes at least one of: repair, replacement and replenishment of the component, and the electronic message indicates the need for the service and includes information to facilitate ordering at least one of: the repair, replacement and replenishment of the other component.

According to yet another aspect, there is provided a system comprising: a machine, a remote communication device associated with a user of the machine, and a communications network coupling the machine with the remote communication device. The machine includes: a processor and at least one other component. The processor determines if the other component needs service and sends an electronic message addressed to the remote communication device via the communications network. The service includes at least one of: repair, replacement and replenishment of the other component. The electronic message indicates the need for the service and includes information to facilitate ordering at least one of: the repair, replacement and replenishment of the other component.

According to yet another aspect, there is provided a storage medium encoded with machine-readable computer program code for ordering components and services for a machine. The storage medium includes instructions for causing the machine to implement a method comprising: applying a signal indicative of a monitored condition of at least one component in the machine to determine if the component needs service, and sending an electronic message addressed to a remote communication device accessible by a user of the machine. The electronic message indicates the need for the service and includes information to facilitate ordering at least one of: the repair, replacement and replenishment of the component.

BRIEF DESCRIPTION OF THE DRAWING

Referring now to the figures, which are exemplary embodiments, wherein like items are numbered alike.

DETAILED DESCRIPTION

Figure 1:
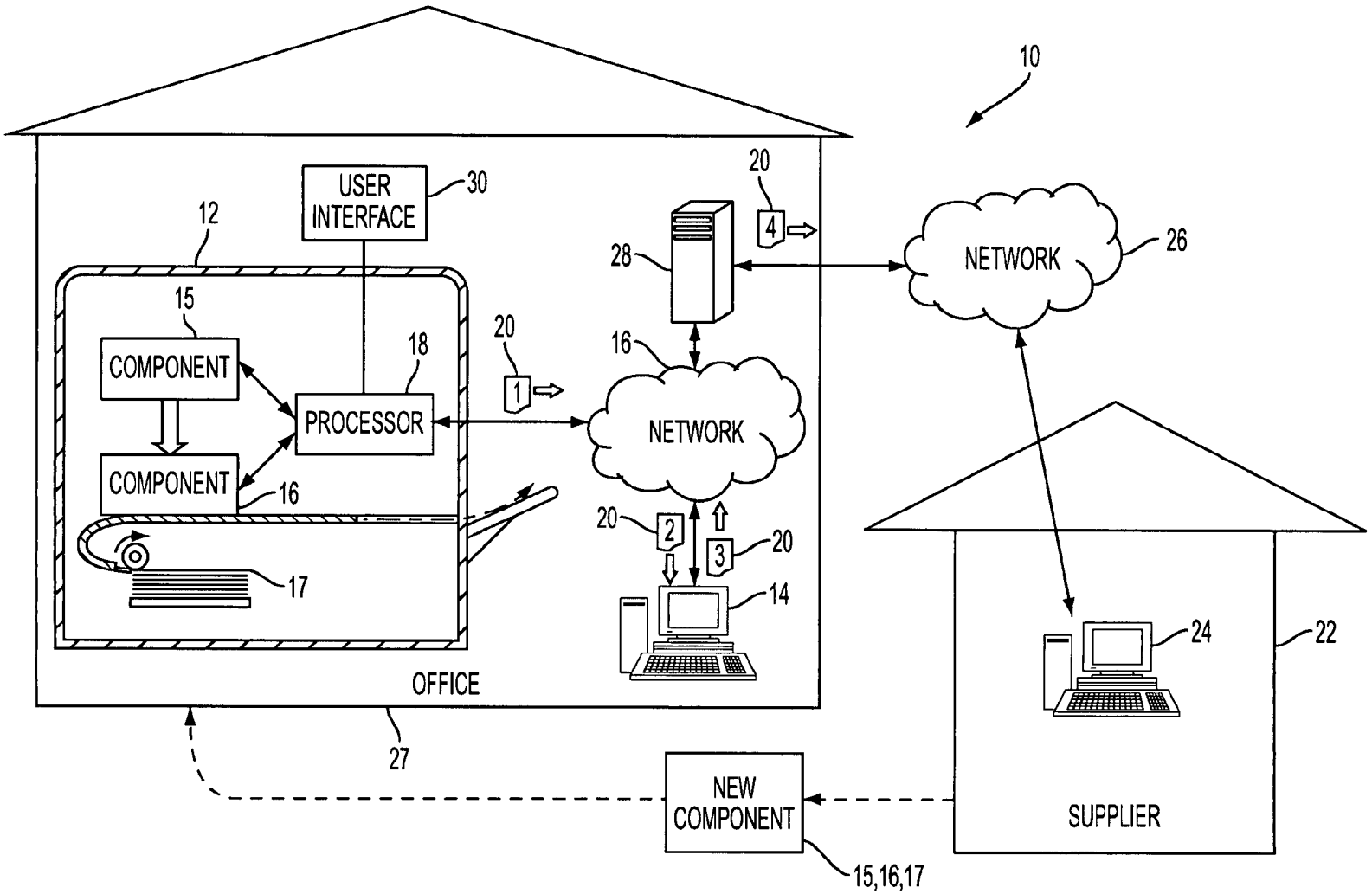
FIG. 1 is a schematic depiction of a system for ordering components and services for a machine.

FIG. 1 is a schematic depiction of a system 10 for ordering components and services for a machine 12. The system 10 includes the machine 12, a remote communication device 14 associated with a user of the machine 12, and a communications network 16 coupling the machine 12 with the communication device 14. The machine 12 includes components 15, 16, 17 and at least one processor 18, which is configured to determine a condition of the components 15, 16 and 17. As will be described in further detail hereinafter, the processor 18 sends an electronic message 20 to the communication device 14 that informs an operator of the communication device 14 of the need to repair, replenish, or replace the component 15, 16 or 17. The message also includes information to facilitate ordering at least one of: the repair, replacement and replenishment of the component 15, 16 or 17. For example, the electronic message 20 may include an order form for use by the operator of the communication device 14 in ordering the repair, replacement or replenishment of the component 15, 16 or 17 from a supplier 22. The processor 18 may populate the order form with sufficient information to place the order of the supplies or service with the supplier 22, thus allowing the operator of the remote communication device 14 to place the order by simply forwarding the electronic message 20 to a remote computer (supplier computer) 24 associated with the supplier 22 via a communications network 26. In response, the supplier 22 sends the new component 15, 16, or 17 to the user or performs the required maintenance on the machine 12.

As used herein, a remote communication device is any device coupled to the machine 12 by at least one computer communications network. The remote communication device 14 may include any one or more: personal computer, workstation computer, laptop computer, handheld computer, palmtop computer, cellular telephone, personal digital assistant (PDA), and any other device capable of communicating electronic messages via the network 16. It is contemplated that the remote communication device 14 is associated with a user who is responsible for ordering supplies maintenance for the machine 12. The network 16 may be, for example, a Local Area Network (LAN) associated with an office 27, building, campus, or other limited geographic space.

The supplier computer 24 may include any one or more: personal computer, workstation computer, laptop computer, mainframe computer, and other computers capable of receiving orders from multiple customers via network 26. The network 26 may include any one or more of: a Wide Area Network (e.g., the Internet, an Intranet, and the like), a telephone network, and the like. Either network 16 and 26 may employ any wired and/or wireless mode of communication. In general, network topologies other than those shown in FIG. 1 may be employed.

In the embodiment shown, the electronic message 20 is sent to the remote communication device 14 via the communications network 16 using an electronic messaging service provided by a message server computer (message server) 28 associated with the communications network 16. The message server 28 includes any one or more computers having: components that handle the transfer of messages to and from other message servers and user computers, a storage area where electronic messages are stored for users of the messaging service, and a set of rules that determine how the message server computer 28 should react to messages and commands from the users. While the message server 28 is shown as being associated with the network 16 (e.g., forming part of the LAN), it will be appreciated that message servers may be associated with the network 26 (e.g., the Internet) and may be accessed by the machine 12 and/or remote communication device 14 via the network 26.

The message server 28 may provide any suitable electronic messaging service to send the electronic message 20 from the machine 12 to the communication device 14, and from the communication device 14 to the supplier computer 24. As used herein, an electronic message is any electronic, file, data, or other information transmitted between computers, servers, processors, terminals, and the like within a computer network. Well-known electronic messaging services include: electronic mail (e-mail), text messaging, instant messaging, Short Messaging Service (SMS), and the like.

For example, the message server 28 may be an e-mail server and the electronic message 20 sent from the machine 12 to the communication device 14 may be an e-mail message. In this embodiment, the processor 18, message server 28, and computers 14 and 16 may employ one or more protocols found in the Transport Control Protocol/Internet Protocol (TCP/IP) suite of protocols to communicate the electronic message 20. The most common TCP/IP protocols used for e-mail are SMTP (Simple Mail Transfer Protocol), Post Office Protocol (POP), and Internet Message Access Protocol (IMAP). In general, SMTP is used in sending and receiving e-mail, while POP and IMAP let the computers 14 and 24 and processor 18 save messages in a mailbox in message server 28 and download them periodically from the message server 28. The MIME (Multipurpose Internet Mail Extensions) protocol may also be used to send binary data across networks 16 and 26. The processor 18, message server 28, and computers 14 and 16 may employ a commercially available e-mail program to send and receive the message 20. Commercially available e-mail programs include, for example, Lotus Notes, Microsoft Outlook and Netscape Communicator.

In another example, instant messaging may be used to provide the electronic message 20 to the communication device 14. Popular instant messaging services on the Internet include MSN (Microsoft Network) Messenger, AOL (America On Line) Instant Messenger, Yahoo! Messenger, and Internet Relay Chat (IRC). In yet another example, text messaging or SMS may be used to provide the electronic message 20 to the communication device 14. Text messaging and SMS are generally applied to send relatively short text messages (e.g., about 160 alpha-numeric characters or less) to and from mobile devices (e.g., a mobile phone) and/or IP addresses.

Figure 2:
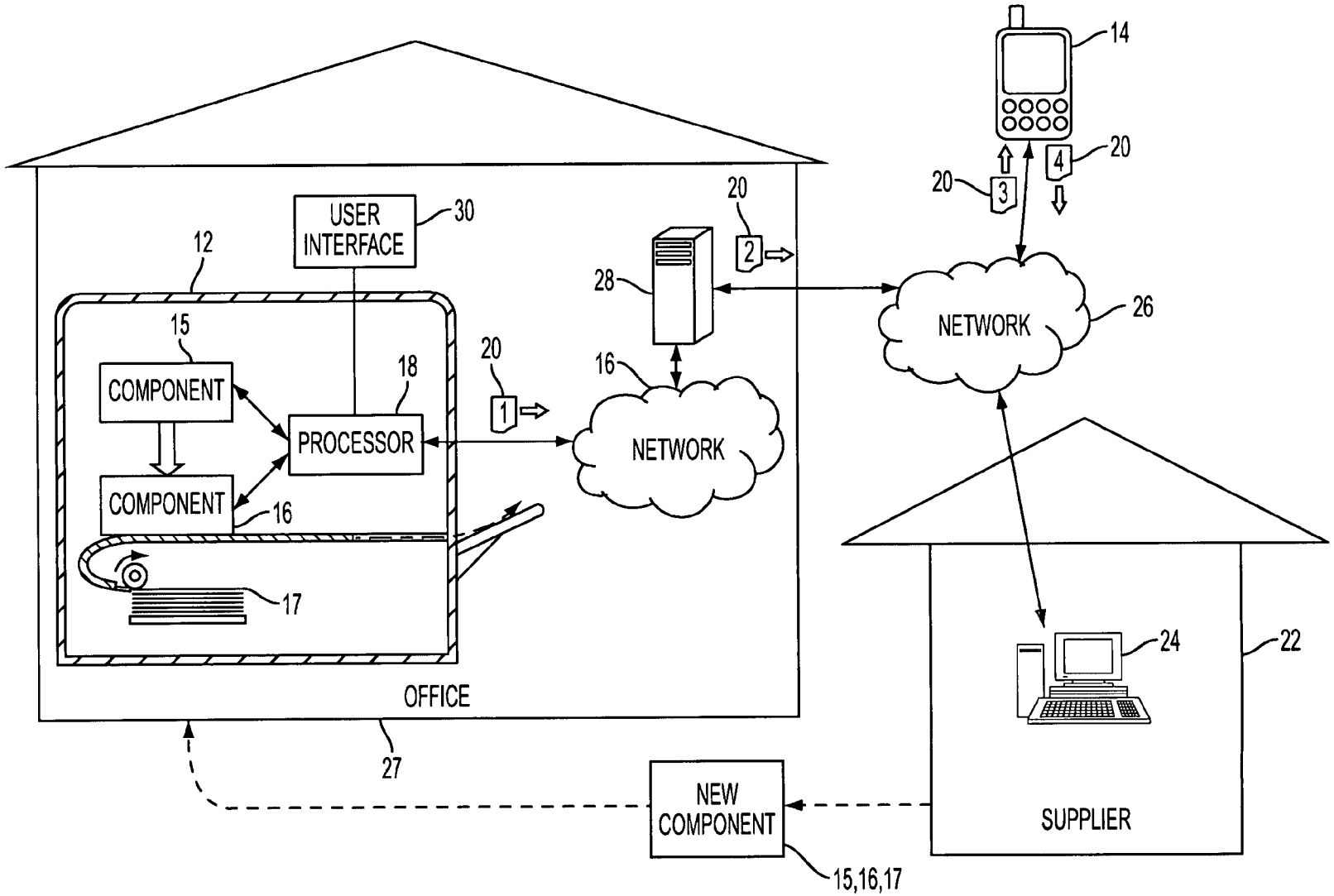
FIG. 2 is an alternative schematic depiction of the system for ordering components and services for the machine.

In the above examples, the electronic message 20 is communicated between the processor 18, communication device 14, and supplier computer 24 using standard communications networks and protocols. Advantageously, this allows the user to retrieve the electronic message 20 from the message server 28 through different remote computers 14, at different locations. In FIG. 2, for example, the communication device 14 is a handheld computer or cellular telephone which accesses the electronic message 20 from the message server 28 via the network 26 (e.g., the Internet).

In the embodiment of FIG. 1, the machine 12 is depicted as a printing machine, such as a digital printer of the ink jet or "laser" (electrophotographic or xerographic) variety, or a digital or analog copier. The components 15, 16, and 17 are depicted as hardware devices and consumable components related to printing, such as a marking material supply component, a marking device component, and a sheet supply stack 17, respectively. It is contemplated, however, that the machine 12 may be any electrical, electronic, mechanical, electromechanical device configured to perform one or more functions, and the components 15, 16, and 17 may each be any single part, group of parts, system, subsystem, or consumable item of the machine 12.

The component 15, 16, or 17 may be repaired, for example by a service technician, to allow continued use of the component 15, 16, or 17 in the machine 12. Alternatively, the component 15, 16, or 17 may be replaced by a new or refurbished component 15, 16, or 17. Or, in the case where the component 15, 16, or 17 is consumable (e.g. a paper supply, toner, etc.), it may be replenished by addition of the consumable component.

In the embodiment of FIG. 1, the processor 18 communicates with the components 15 and 16 via data paths, which are indicated by double-ended arrows in FIG. 1. Processor 18 also communicates with users through a user interface 30 and through the network 16.

In operation, sheets on which images are to be printed are drawn from the stack 17 and move relative to the marking device component 16, where the individual sheets are printed upon with desired images. The marking material for placing marks on various sheets by marking device component 16 is provided by marking material supply component 15. If machine 12 is an electrostatographic printer, marking material supply component 15 may include a supply of toner, while marking device component 16 includes any number of hardware items for the electrostatographic process, such as a photoreceptor or fusing device. In the well-known process of electrostatographic printing, the most common type of which is known as "xerography," a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finally divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate, such as paper from the stack 17, and the image affixed thereto to form a permanent record of the image.

In the ink-jet context, the marking material supply component 15 includes a quantity of liquid ink, and may include a separate tanks for different primary-colored inks, while marking device component 16 includes a printhead. In either the electrostatographic or ink-jet context, "marking material" can include other consumed items used in printing but not precisely used for marking, such as oil or cleaning fluid used in a fusing device.

In the current market for office equipment, for example, it is typically desirable that components such as 15 and 16 are configured as modules that are readily replaceable by the end user, thus saving the expense of having a representative of the supplier visit the user. Of course, depending on a particular design of a machine 12, the functions of components 15 and 16 may be combined in a single module, or alternatively, only one of the components 15 and 16 may be modularized. Further, there may be provided several different modules for marking material supply component 15, such as in a full color printer. In general, there may simply be provided one or more components associated with the machine 12, and it is expected that, at times within the life of machine 12, one or more of these components need to be serviced or replaced.

Figure 3:
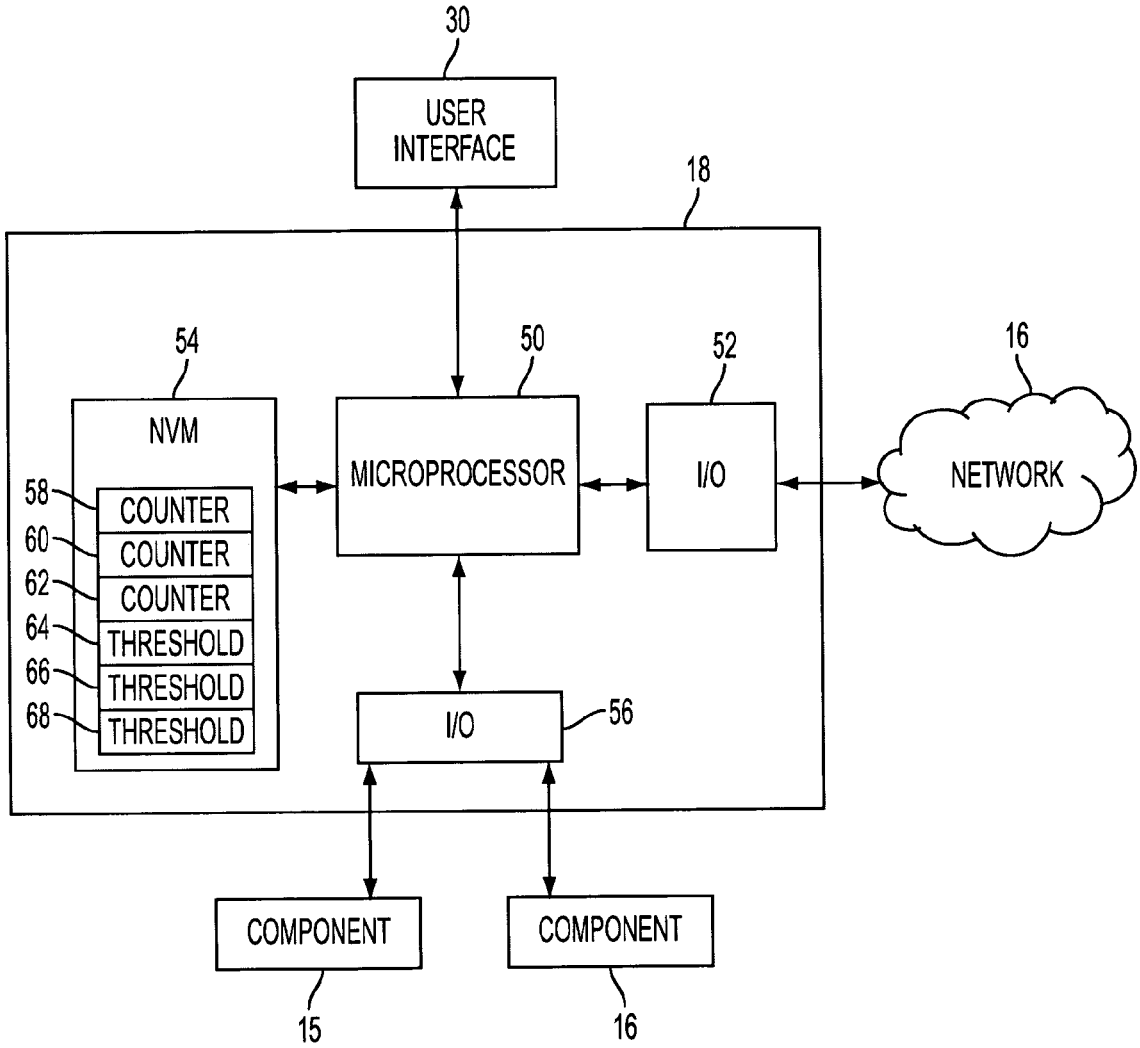
FIG. 3 is a schematic depiction of a processor in the machine of FIG. 1.

FIG. 3 depicts an example of a processor for use in the machine 12 of FIG. 1. The processor includes a microprocessor 50 which may contain random access memory (RAM) for performing data calculations and manipulations and read only memory (ROM) for storing software to enable the various operations of the processor 18. Input information may be provided to the microprocessor 50 through the user interface 30 or through input/output (I/O) devices 52 and 56. I/O device 52 may be a network card for data coupling with network 16. I/O device 56 may be any device which amplifies, filters, or otherwise conditions or alters electronic signals to allow data communication between the microprocessor 50 and the components 15 and 16. Coupled to the microprocessor 50 is a non-volatile memory device 54, such as an electrically erasable programmable read-only memory (EEPROM), hard disk drive, or the like, That retains its contents when power to The processor 18 is turned off. While one example of processor 18 is shown, it is contemplated that processor IS may comprise any number of microprocessors, printed wiring boards (PWBs), application specific integrated circuits (ASICS), data input/output devices (e.g., network interface cards), sensors, memory (e.g., Non-Volatile Memory (NVM), Read Only Memory (ROM), Random Access Memory (RAM)), and the like.

Figure 4:
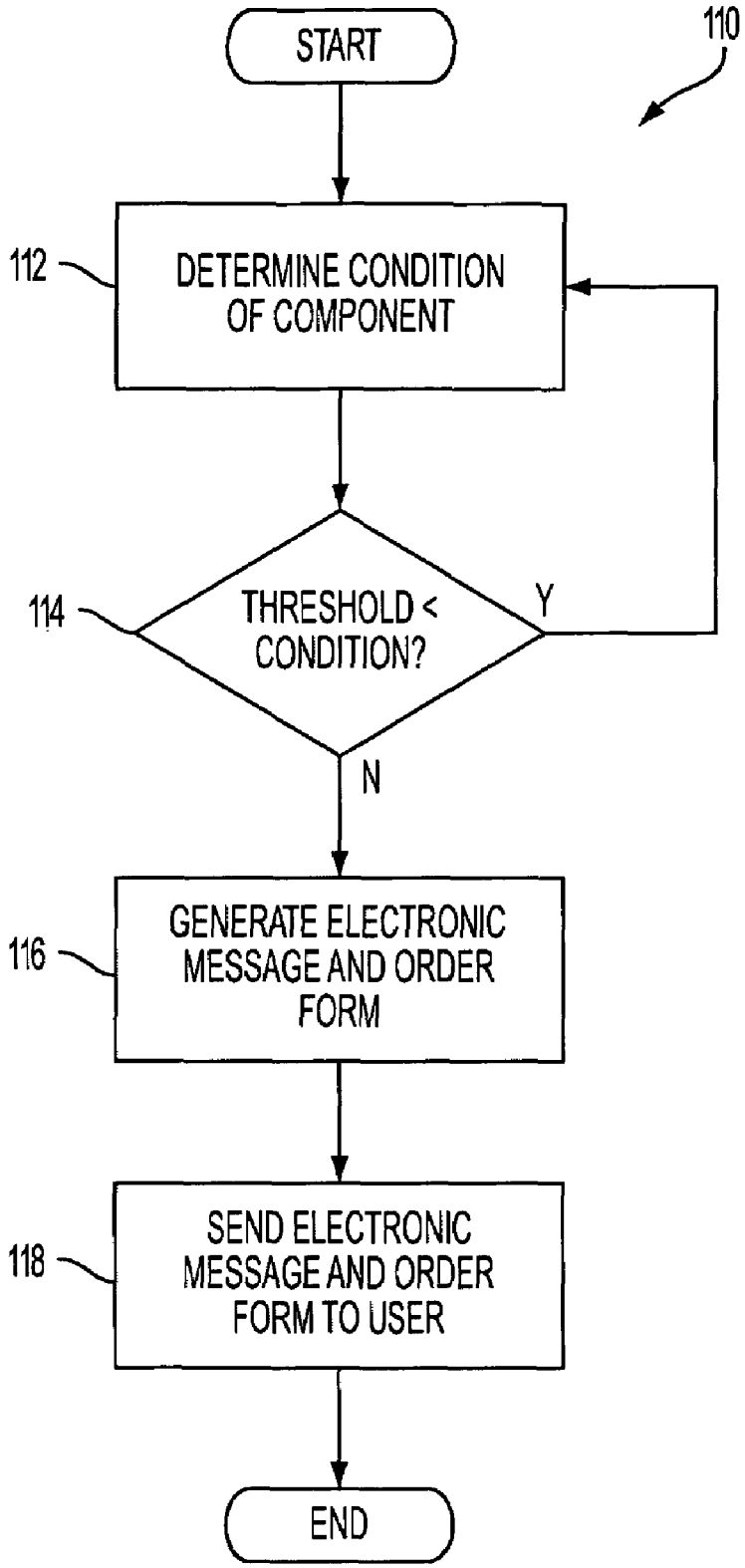
FIG. 4 is a flow chart depicting a method for ordering components and services implemented by the processor of FIG. 3.

FIG. 4 depicts a flow chart of a method 110 for ordering supplies end services that may be employed by the processor 18 of FIG. 3. Referring to FIGS. 3 and 4, the method 110 begins at step 112, where the processor 18 determines a condition of one or more of the components 15, 16, 17. This step 112 may be performed periodically, or each time the machine 12 (FIG. 1) is operated. As used herein, a condition of a component is any state of being of the component and may include: remaining or depleted supply of a consumable component, rate of depletion of a consumable component, age of a component, health of a component, usage of a component, wear of a component, and rate of wear of a component.

For example, the processor 18 may implement counters 58, 60, and 62 for each component 15, 16, and 17 being tracked. In the example shown in FIG. 3, counters 58, 60, and 62 are implemented in NVM 54; however, it is contemplated that any of the counters 58, 60, and 62 may be implemented in hardware, or counters 58 and 60 may be implemented in memory associated with the components 15 and 16. After the completion of a print run, the microprocessor 50 decrements (or increments) each counter 58, 60, and 62 such that the count value from each counter 58, 60, and 62 is indicative of the condition of the corresponding component 15, 16, and 17. The count provided by the counter 58 associated with marking material supply component 15 is indicative of the amount of marking material (e.g., toner, ink, etc.) remaining in the module. The count provided by the counter 60 associated with marking device component 16 is indicative of the usage and remaining life of the hardware items in the component 16, and the counter 62 associated with the stack 17 is indicative of the number of sheets used from, and remaining in, the stack 17. It will be appreciated that after a component has been serviced or replaced, the counter associated with that component may be reset.

In step 114 of method 110, the microprocessor 50 compares the condition (e.g., the count in each counter 58, 60, and 62) to a threshold condition. As used herein, a threshold condition is a predetermined characteristic or value against which the condition is compared to determine a need to service or replace the component.

In the embodiment shown, the threshold condition for each component 15, 16, and 17 is a corresponding threshold count value 64, 66, and 68 stored in NVM 54. The microprocessor 50 compares the count value from each counter 58, 60, and 62 to a corresponding threshold count value 64, 66, and 68 to determine if the corresponding component 15, 16, or 17 needs to be serviced or replaced. For example, if the count provided by the counter 58 associated with marking material supply component 15 reaches the threshold value 64, this may indicate that the marking material in the component 15 is low, and a new marking material supply component 15 should be reordered. If the count provided by the counter 60 associated with marking device component 16 reaches its associated threshold value 66, this may indicate that one or more hardware components are reaching the end of their expected life, and the component 16 should be serviced or replaced. If the count provided by the counter 62 associated with the stack 17 reaches its associated threshold value 68, this may indicate that new sheets should be ordered to replenish the stack 17.

If, in step 114, the microprocessor 50 determines that a condition has not reached its threshold value (e.g., the count from any of the counters 58, 60, and 62 have not reached their associated thresholds 64, 66, and 68), the method 110 returns to step 112.

If, in step 114, the microprocessor 50 determines that a condition has reached its threshold value (e.g., the count from any of the counters 58, 60, and 62 has reached its associated threshold 64, 66, or 68), the method 110 proceeds to step 116, where microprocessor 50 generates the electronic message 20 with the order form. As will be described hereinafter, the microprocessor 50 retrieves the order form from NVM 54 along with at least some of the information required to populate the fields in the order form. Next, in step 118, the microprocessor 50 sends the electronic message 20 with the order form to the communication device 14, as described in FIG. 1. After step 116, the method 110 may end, or the method 110 may proceed again to step 112.

Figure 5:
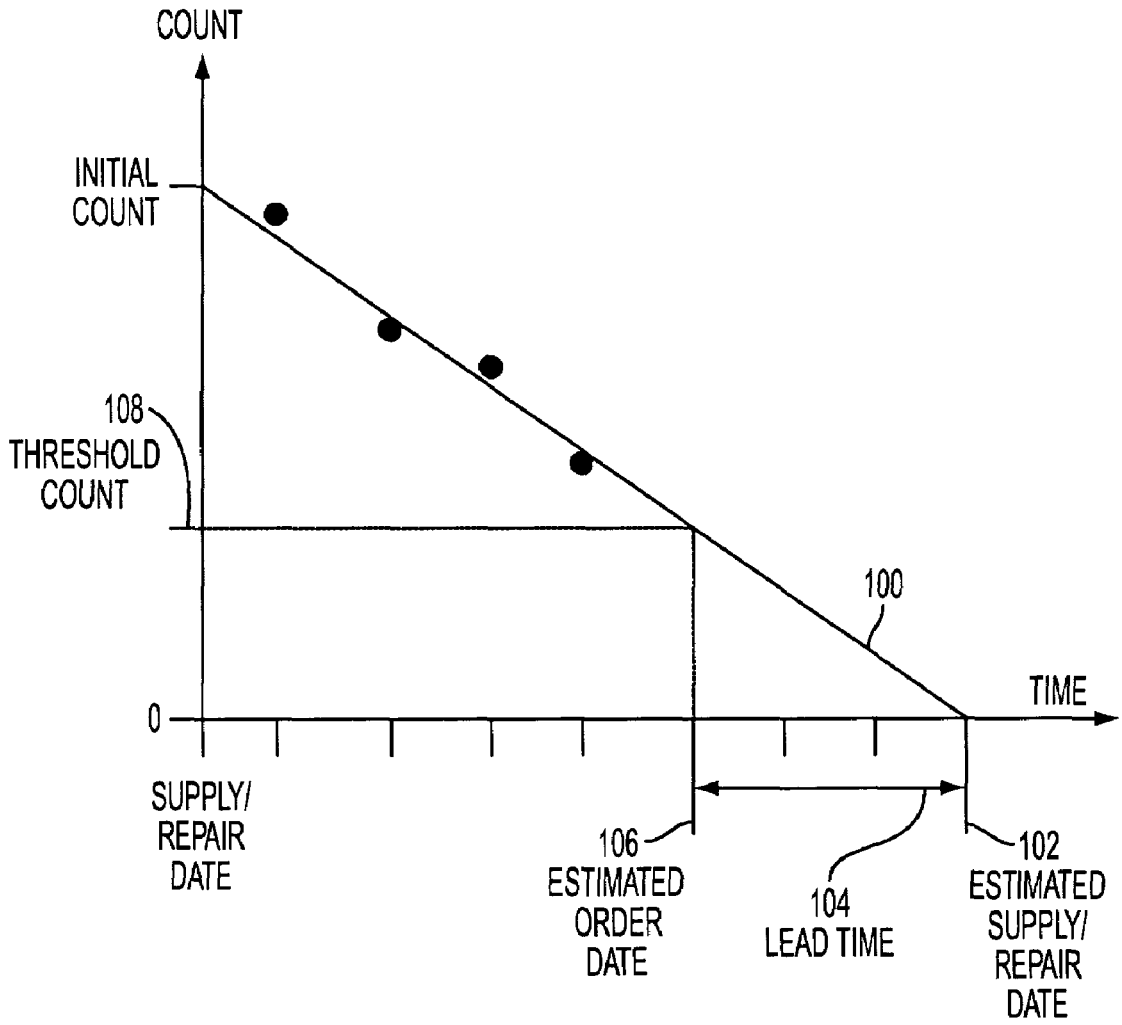
FIG. 5 is plot depicting a rate of component usage.

The threshold values 64, 66, and 68 may be input by the manufacturer of the machine 12 or by a user of the machine 12 by way of the user interface 30. Alternatively, the microprocessor 50 may calculate one or more of the threshold values 64, 66, and 68 based on a rate of usage. For example, FIG. 5 depicts a plot of usage (e.g., count) as a function of time, as may be generated by the microprocessor 50. A curve 100 is fit to the actual usage data, where the y-intercept of the curve 100 represents the count at the date of service or replacement of the component, and the x-intercept of the curve 100 represents an estimated date that the next service or replacement is needed (need date 102). It will be appreciated that, to avoid inoperability of the machine 12 due to the needed supplies or services, the supplies or services should be ordered before the estimated need date 102 by an ordering lead time, which is indicated at 104. The microprocessor 50 can determine an estimated ordering date 106 by subtracting the ordering lead time 104 from the estimated date 102. In turn, a threshold value 108 can be determined as the count associated with the estimated ordering date 106.

While the processor 18 of FIG. 3 employs counters 58, 60 and 62 to determine the condition of the components 15, 16, and 17, it is contemplated that other parameters of the components 15, 16, and 17 may be monitored to determine their conditions. For example, physical parameters of the components (e.g., temperature, vibration, sound, and the like) may be monitored. In another example, output from the components (e.g., error messages) may be monitored.

Figure 6:
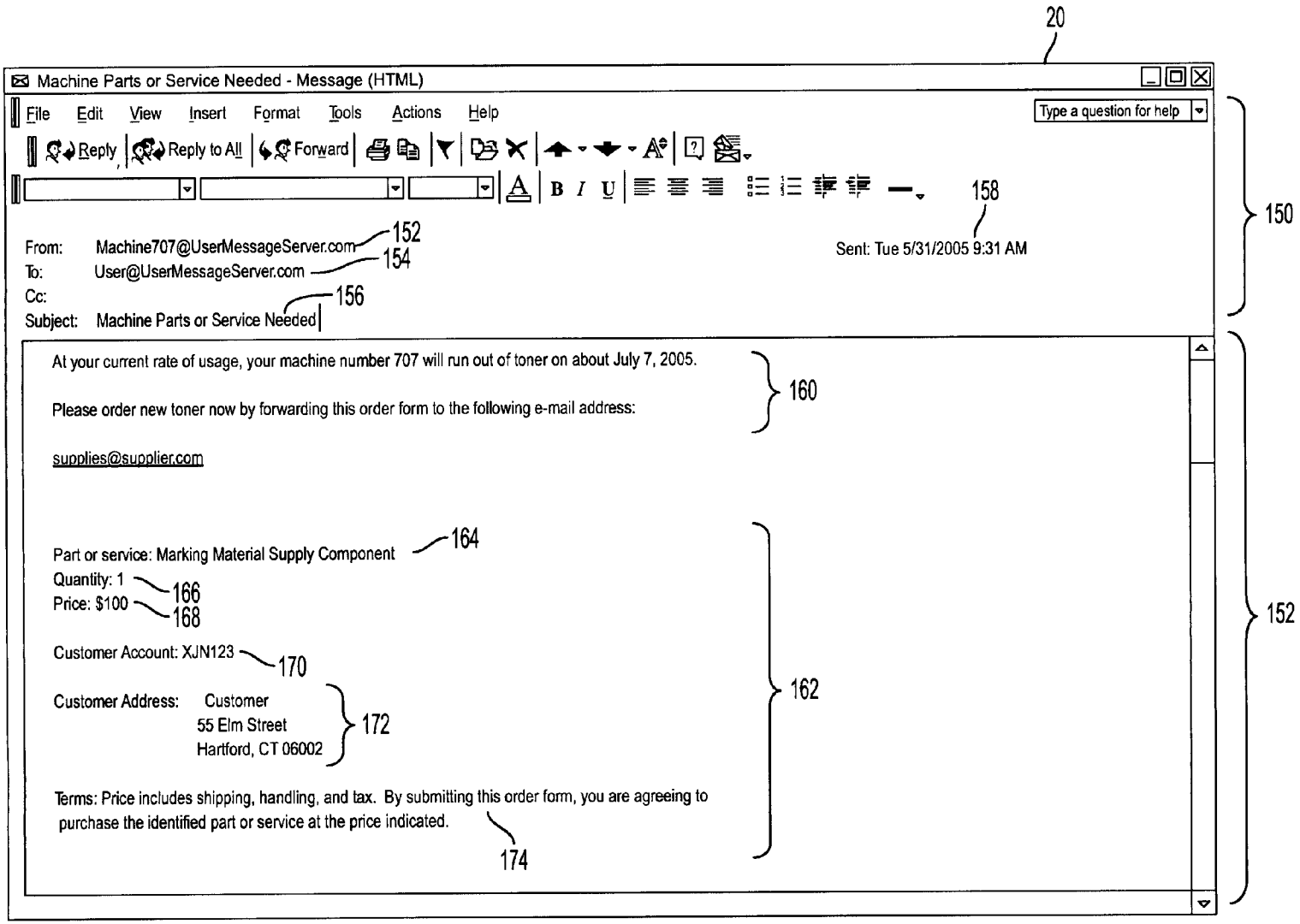
FIG. 6 is a view of an electronic message including an order form for use in ordering components and services for the machine.

Referring to FIG. 6, an example of the electronic message 20 is shown. The electronic message 20 includes two major components: a header 150 and a body 152. The header 150 may include a message summary or subject, a sender, a receiver, and other identifying information about the message. In the example shown, the header 150 includes four fields: a "From" field 152 indicating the address of the sender of the message 20 (the machine 12 of FIG. 1); a "To" field 154 indicating the address of the receiver of the message 20 (the communication device 14 of FIG. 1); a "Subject" field 156 providing a brief summary of the contents of the message 20; and a "Date" field 158 indicating the time and date when the message 20 was originally sent. Each address is a character string which identifies the sender or receiver, and include a user identification and host name (e.g., User@UserMessageServer.com).

In the embodiment shown, the body 152 of the message 20 includes an indication of the need for service or replacement of the component, as shown at 160, and an order form, as shown at 162. It is contemplated, however, that the order form 162 may be a separate file attached to the message 20. As used herein, an "order form" is an electronic document that may be used to request supplies and/or service in return for payment. The order form includes fields, spaces, or blanks (hereinafter "fields") for the insertion of information relating to the request. For example, the order form may include: a field 164 identifying the needed supplies or service, a field 166 identifying a quantity of the needed supplies or service, a field 168 identifying a price of the requested supplies or service, a field 170 identifying a customer account number, a field 172 identifying a customer name and address, and a field 174 identifying terms and conditions of the order.

As previously noted, before sending the message 20 to the communication device 14, the microprocessor 50 retrieves the order form 162 from NVM 54 along with at least some of the information required to populate the fields 164-174 in the order form 162. The order form 162 and the information needed to populate the order form may be stored in NVM 54 upon initial installation of the machine 12 and may be periodically updated by the supplier 22 via networks 16 and 26. For example, the user name and address, the supplier name and address, and a catalogue of various supplies and services that the machine 12 may require can be stored in the NVM 54 upon initial installation of the machine 12. Other information such as price of the supplies or service and terms and conditions of an order may be updated periodically by the supplier 22.

The machine 12, through the use of an electronic message 20, notifies a user of the machine 12 when the machine 12 needs supplies or services. Because the message 20 includes an order form 162, the user can place the order by simply forwarding the message 20 to the supplier 22. Furthermore, because the order form 162 is populated with information required to place the order, the user saves the time that would normally be required to fill in this information. Also, unlike prior art methods, the method 110 of FIG. 4 does not automatically place an order without customer action. The customer is in control of the order process. Finally, because the electronic message 20 is communicated using standard communications networks and protocols (e.g. e-mail), the user can retrieve the electronic message 20 through different remote computers 14, at different locations.

It is contemplated that the method 10 can be embodied in the form of computer program code containing instructions embodied in tangible media, such as floppy diskettes, CD-ROMs, hard drives, or any other computer-readable storage medium, wherein, when the computer program code is loaded into and executed by the processor 18 in machine 12, the machine 12 becomes an apparatus for practicing the method 110. It is also contemplated that the method 110 can be embodied in the form of computer program code containing instructions transmitted over some transmission medium, such as over electrical wiring or cabling, through fiber optics, or via electromagnetic radiation, wherein, when the computer program code is loaded into and executed by the processor 18 in machine 12, the machine 12 becomes an apparatus for practicing the method 110.

It should be understood that any of the features, characteristics, alternatives or modifications described regarding a particular embodiment herein may also be applied, used, or incorporated with any other embodiment described herein.

A number of embodiments of the present invention have been described. Nevertheless, it will be understood that various modifications may be made without departing from the spirit and scope of the invention. Accordingly, other embodiments are within the scope of the following claims.

What is claimed is:

1. A machine comprising:

a processor; and at least one other component, wherein the processor comprises:

means for determining if the other component needs service, the service including at least one of: repair, replacement and replenishment of the other component, and means for sending an electronic message to a remote communication device selectable by and accessible by a user of the machine, wherein the electronic message indicates the need for the service and includes information to facilitate ordering at least one of: the repair, replacement and replenishment of the other component, the information including a name of a supplier of the other component, an address of the supplier and an address and account number of the user, and the information is contained in an order form for forwarding by the user to the supplier to effect said ordering of at least one of: the repair, replacement and replenishment of the other component.

2. The machine of claim 1, wherein the order form is sent electronically from the user of the machine to a supplier of at least one of: repair, replacement and replenishment of the other component.

3. The machine of claim 1, wherein the electronic message includes at least one of: an e-mail message, a text message, an instant message, and a Short Messaging Service (SMS) message.

4. The machine of claim 1, wherein the other component includes at least one of: hardware for printing and a consumable component for printing.

5. The machine of claim 1, wherein the other component includes at least one of: hardware for electrostatographic printing and a consumable component for electrostatographic printing.

6. The machine of claim 1, wherein the information further includes at least one of: a price of a supply or service of the other component, an identification number of the supply or service and terms and conditions of the order.

7. A method of ordering components and repair services for a machine, the method comprising:

monitoring a condition of at least one component in the machine;

transmitting a signal indicative of the monitored condition to a processor in the machine;

applying the signal within the processor to determine if the component needs service, the service including at least one of: repair, replacement and replenishment of the component, sending an electronic message from the processor to a remote communication device selectable by and accessible by a user of the machine via a local area communications network, the electronic message indicating the need for the service and including information to facilitate ordering at least one of: the repair, replacement and replenishment of the component, the information including an order form containing a name of a supplier of the other component, an address of the supplier and an address and account number of the user, the order form suitable for forwarding by the user to the supplier to effect said ordering; and forwarding the electronic message from the user of the machine to a supplier of at least one of the repair, replacement and replenishment of the other component via a communication network connecting the remote communication device to the supplier.

8. The method of claim 7 wherein the electronic message includes at least one of: an e-mail message, a text message, an instant message, and a Short Messaging Service (SMS) message.

9. The method of claim 7 wherein the component includes at least one of: hardware for printing and a consumable component for printing.

10. The method of claim 7 wherein the component includes at least one of: hardware for electrostatographic printing and a consumable component for electrostatographic printing.

11. The method of claim 7, wherein the order form further includes at least one of: a price of a supply or service of the component, an identification number of the supply or service and terms and conditions of the order.

12. A system comprising:

a machine including:

a processor, and at least one other component;

a remote communication device associated with a user of the machine, said remote communication device selectable by and accessible by the user; and a communications network coupling the machine with the remote communication device, wherein the processor comprises:

means for determining if the other component needs service, the service including at least one of: repair, replacement and replenishment of the other component, and means for sending the electronic message addressed to the remote communication device via the communications network, the electronic message indicating the need for the service and including information to facilitate ordering at least one of: the repair, replacement and replenishment of the other component, the information including a name of a supplier of the other component, an address of the supplier and an address and account number of the user, wherein the information is contained in an order form for forwarding by the user to the supplier to effect said ordering of at least one of: the repair, replacement and replenishment of the other component.

13. The system of claim 12, wherein the order form is sent electronically from the user of the machine to a supplier of at least one of: the repair, replacement and replenishment of the other component.

14. The system of claim 12, wherein the electronic message includes at least one of: an e-mail message, a text message, an instant message, and a Short Messaging Service (SMS) message.

15. The system of claim 12, wherein the machine is an electrostatographic printing device.

16. The system of claim 12, wherein the information further includes at least one of: a price of a supply or service of the component, an identification number of the supply or service and terms and conditions of the order.

17. A storage medium encoded with machine-readable computer program code for ordering components and services for a machine, the storage medium including instructions for causing the machine to implement a method comprising:

applying a signal indicative of a monitored condition of at least one component in the machine to determine if the component needs service, the service including at least one of: repair, replacement and replenishment of the component, and sending an electronic message addressed to a remote communication device selectable by and accessible by a user of the machine, the electronic message indicating the need for the service and including information to facilitate ordering at least one of: the repair, replacement and replenishment of the component, the information including a name of a supplier of the component, an address of the supplier and an address and account number of the user, wherein the information is contained in an order form for forwarding by the user of the machine to effect said ordering of at least one of: the repair, replacement and replenishment of the other component.

18. The storage medium of claim 17, wherein the information further includes at least one of: a price of a supply or service of the component, an identification number of the supply or service and terms and conditions of the order.

19. A method of ordering components and repair services for a machine, the method comprising:

monitoring a condition of at least one component in the machine;

transmitting a signal indicative of the monitored condition to a processor in the machine;

applying the signal within the processor to determine if the component needs service, the service including at least one of: repair, replacement and replenishment of the component;

preparing an electronic message including an order form suitable for use by the user of the machine in ordering at least one of said repair, replacement and replenishment of the other component, the order form including a name of a supplier of the component, an address of the supplier, an address and account number of the user and at least one of: a price of a supply or service of the component, an identification number of the supply or service, and the terms and conditions of the order, the order form being suitable for forwarding by the user to the supplier to effect said ordering of at least one of said repair, replacement and replenishment of the other component;

sending the electronic message from the processor to a remote communication device selectable by and accessible by a user of the machine via a local communications network, and forwarding the electronic message from the user of the machine to a supplier of at least one of the repair, replacement and replenishment of the other component via a wide area communication network connecting the remote communication device to the supplier.

20. The method of claim 19, wherein the electronic message includes at least one of: an e-mail message, a text message, an instant message, and a Short Messaging Service (SMS) message.

21. The method of claim 19, wherein the component includes at least one of: hardware for electrostatographic printing and a consumable component for electrostatographic printing.

22. The method of claim 19, wherein the component includes at least one of: hardware for printing and a consumable component for printing.

23. A system comprising:

a machine including:

a processor, and at least one other component;

a remote communication device associated with a user of the machine, said remote communication device selectable by and accessible by the user; and a local communications network coupling the machine with the remote communication device, wherein the processor comprises:

means for determining if the other component needs service, the service including at least one of: repair, replacement and replenishment of the other component, and means for sending an electronic message addressed to the remote communication device via the communications network, the electronic message indicating the need for the service and an order form suitable for use by the user of the machine in ordering at least one of: the repair, replacement and replenishment of the other component, the order form including the name of a supplier of the other component, an address of the supplier, an address and account number of the user and at least one of: a price of a supply or service of the other component, an identification number of the supply or service and up to date terms and conditions of the order, the order form suitable for forwarding by the user to the supplier to effect said ordering;

the system further including means for sending the electronic message from the user of the machine to the supplier via a wide area communications network coupling the remote communications device and the supplier.

* * * * *